United States Patent [19]

Bunk et al.

[11] Patent Number: 4,789,439

[45] Date of Patent: Dec. 6, 1988

[54] METHOD OF ELECTROLYTIC TINNING USING AN INSOLUBLE ANODE

[75] Inventors: Huig Bunk; Gijsbertus C. Van Haastrecht, both of Beverwijk; Joop N. Mooij, Castricum, all of Netherlands

[73] Assignee: Hoogovens Groep B.V., Ijmuiden, Netherlands

[21] Appl. No.: 112,069

[22] Filed: Oct. 26, 1987

[30] Foreign Application Priority Data

Oct. 30, 1986 [NL] Netherlands ..... 8602730

[51] Int. Cl.[4] ..... C25D 7/06

[52] U.S. Cl. ..... 204/28

[58] Field of Search ..... 204/28, 54.1, 54.5, 204/233, 234

[56] References Cited

U.S. PATENT DOCUMENTS 4,181,580 1/1980 Kitayama ..... 204/28

4,290,856 9/1981 Inoue ..... 204/234

*Primary Examiner*—T. M. Tufariello

*Attorney, Agent, or Firm*—Stevens, Davis, Miller & Mosher

[57] ABSTRACT

A method of electrolytic tinning of metal in strip form using an insoluble anode, comprises passing the strip to be tinned through an electrolytic tinning bath having an insoluble anode, the strip forming the cathode, to deposit tin from the electrolyte onto the strip, and circulating the electrolyte through an electrolytic replenishing cell outside the tinning bath for addition of tin ions in order to maintain the desired concentration of tin ions in the tinning bath. The replenishment cell has a tin anode chamber with a tin anode system, a cathode chamber having an insoluble cathode, and a membrane between them substantially impermeable to tin ions. To make the replacement of the anode easier and to improve efficiency, the tin anode system of the replenishing cell comprises an insoluble tin anode and a bed of granular tin material which is fluidized by the electrolyte.

5 Claims, 2 Drawing Sheets

METHOD OF ELECTROLYTIC TINNING USING AN INSOLUBLE ANODE

BACKGROUND OF THE INVENTION

1. Field of the Invention

The invention relates to a method for the electrolytic tinning of metal in strip form using an insoluble anode. The metal in strip form is known as tinplate and may be steel not previously tinplated or previously tinned strip.

2. Description of the Prior Art

U.S. Pat. No. 4,181,580 describes a tinning process in which the tinplate in strip form is passed as cathode through a tinning bath containing an acidic liquid electrolyte including tin ions, so that tin ions are deposited on the strip. The electrolyte from the tinning bath is transported to a source of tin ions located outside the tinning bath and is there enriched with tin ions. The electrolyte is then returned to the tinning bath, the concentration of tin ions in the electrolyte in this way being kept up to a desired level. The source of tin ions is a reactor using oxygen in which tin is dissolved by a chemical method. A big disadvantage of the known method is that the unwanted reaction $Sn^{2+} \rightarrow Sn^{4+}$ occurs, so that approximately 4% of the tin is converted to sludge. This makes a separate sludge removal system necessary.

Methods of replenishing a plastics electrolyte using electrolytic processes are disclosed in DE-A No. 2027793, GB-A No. 2041408 and FR-A No. 2479856. In particular DE-A No. 2027793 describes a replenishment cell through which the electrolyte, for example a tinplating electrolyte, is passed through a replenishment cell having anode chamber containing a soluble anode which is dissolved to enrich the electrolyte, a cathode chamber and a membrane substantially impermeable to the metal ions of the electrolyte.

Electrolyte replenishment has the advantages that:

(1) Process control is simpler, than in the method of U.S. Pat. No. 4,181,580, since the electrical power used can be controlled much more easily than the feeding of oxygen into the electrolyte.

(2) No or virtually no tetravalent tin ions are formed, and no or virtually no sludge is produced.

(3) The apparatus can be much more compact and cheaper than the oxygen reactor.

However, the known electrolytic replenishment processes have some defects, particularly the need to replace the soluble electrode from time to time. It is also desired to improve efficiency.

SUMMARY OF THE INVENTION

The object of the invention is to provide a method of electrolytic tinning using an insoluble anode in the tinning bath and electrolytic replenishment of the tinning electrolyte, in which the problem of replacement of the anode in the replenishment cell is avoided or reduced and in which efficiency is increased.

According to the invention in the electrolytic replenishment cell, the tin anode system comprises an insoluble anode and a bed of granular tin material. The advantage of this is that the tin being dissolved can be replaced continuously or from time to time in the form of granular tin material. The granular tin is dissolved into the electrolyte by contact with the insoluble anode during electrolysis.

Circulation of the tinning electrolyte may take place continuously or intermittently during the tinning process.

Preferably the electrolyte is added to the tin anode chamber of the replenishment cell to a compartment in the anode chamber which is bounded at its upper side by a perforated (foraminate) plate. This plate distributes the electrolyte through the bed of granular tin material, and supports the bed of granular tin material. The electrolyte flows through the plate and the bed in an upwards direction. As a result with a relatively simple structural arrangement of the electrolytic cell a good flow distribution of the electrolyte in the tin anode chamber is obtained.

Preferably the electrolyte flows through the tin anode chamber at such a speed that the bed of granular tin material is fluidised. An advantage of this is that the electrolytic cell can be constructed even more compactly as the transfer of material is greater in the fluidized bed. In addition, any oxide skin on the tin grains in the fluidized bed is broken and/or abraded when the grains touch each other during the continuous movement of the grains with respect to each other.

Another advantage is that, although the current strength required in the electrolytic cell is high, the current density, being the current strength related to the large anode surface of the granular tin material, is low. As a result the necessary voltage and hence the energy consumption is low.

Another consequence of the low current density is that there is still less oxidation $Sn^{2+} \rightarrow Sn^{4+}$. A further advantage is that with a low energy consumption only a small quantity of heat is developed in the electrolytic replenishment cell, so that the cooling capacity required can be small.

A higher pressure is preferably maintained in the cathode chamber of the electrolytic replenishment cell during operation than in the tin anode chamber. This further counteracts the transport of tin ions through the membrane.

BRIEF INTRODUCTION OF THE DRAWINGS

A preferred embodiment of the invention will be described below by way of non-limitative example and illustrated with reference to the drawing, in which FIG. 1 shows a process diagram of an embodiment of the method in accordance with the invention, and FIG. 2 shows the electrolytic cell use in the process of FIG. 1.

DESCRIPTION OF THE PREFERRED EMBODIMENT

Figure 1:
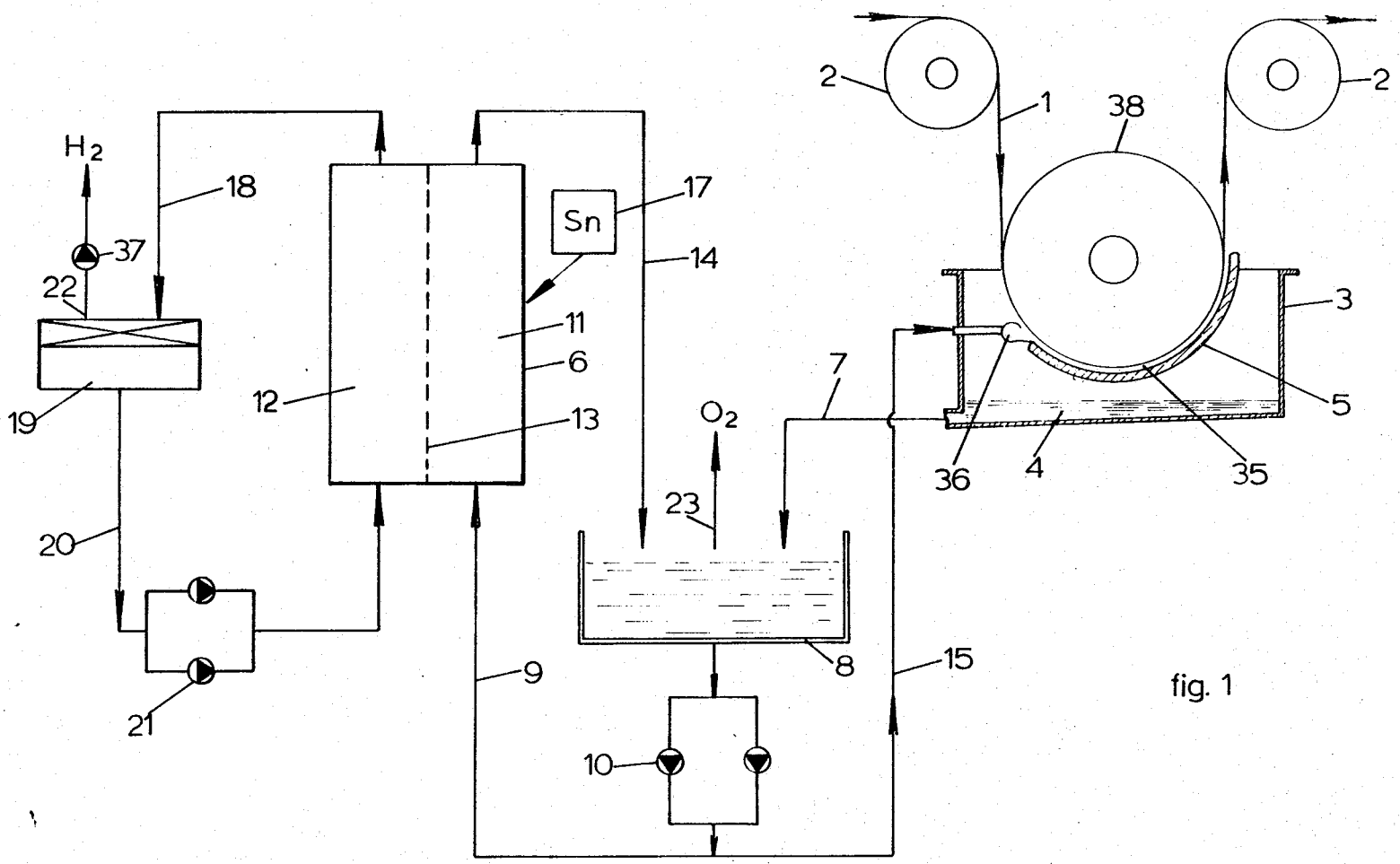

FIG. 1 shows a strip 1 of tinplate which is passed as a cathode by means of reversing rollers 2 through a tinning bath 3. The tinning bath 3 shown in FIG. 1 is of the radial type, but can also be of a more conventional type with flat anodes. The radial tinning bath 3 shown comprises a cathode roller 38 over which the strip 1 is moved and a curved insoluble anode 5 arranged with a gap 35 between the strip 1 and the anode 5. At entry location 36 liquid electrolyte containing tin ions is forced under pressure into the gap 35, and in this gap under the influence of the electric field between the strip 1 as cathode and the anode 5 tin ions are deposited from the electrolyte onto the strip 1. The electrolyte running out of the gap 35 is collected at location 4 at the bottom of the tinning bath.

Tin ions are continuously removed from the electrolyte during the tinning of the strip 1, and are added to replenish the electrolyte in the electrolytic replenishing cell 6, through which the electrolyte is circulated. The electrolyte is transported through a pipe 7 from the tinning bath 3 to the circulation bath 8 and is transported by a pump 10 through a pipe 9 from the circulation bath 8 to the electrolytic cell 6. The electrolytic replenishing cell 6 comprises a tin anode chamber 11 and a cathode chamber 12 with a wall 13 between them which is impermeable or virtually impermeable to tin ions. This is described in more detail below.

The electrolyte is passed into the anode chamber 11. The anode system is described below. Tin ions are formed electrolytically in accordance with the reaction.

$$Sn \rightarrow Sn^{2+} + 2e^-$$

are added to the electrolyte. The electrolyte is then returned via a pipe 14 to the circulation bath 8 and from there via a pipe 15 to the tinning bath 3. The tin dissolved in the tin anode chamber 11 electrolytically is replaced continuously or intermittently by a tin granulate feed device indicated by arrow 17. Suitably the granular tin has an average particle diamter in the range 0.1 to 10 mm, most preferably about 5 mm.

The catholyte in the cathode chamber 12 is circulated via a pipe 18, an overflow bath 19 and a pipe 20 using a pump 21. In the cathode chamber 12 a reaction also takes place. For example, hydrogen electrolytically formed in the catholyte in accordance with the reaction $$2H_3O^+ + 2e^- \rightarrow H_2 + 2H_2O$$

is aspirated at 22 by a fan 37 from the overflow tank 19.

The oxygen formed in the tinning bath 3 on anode 5 escapes from the tinning bath 3 and also at 23 from the circulation tank 8.

Figure 2:
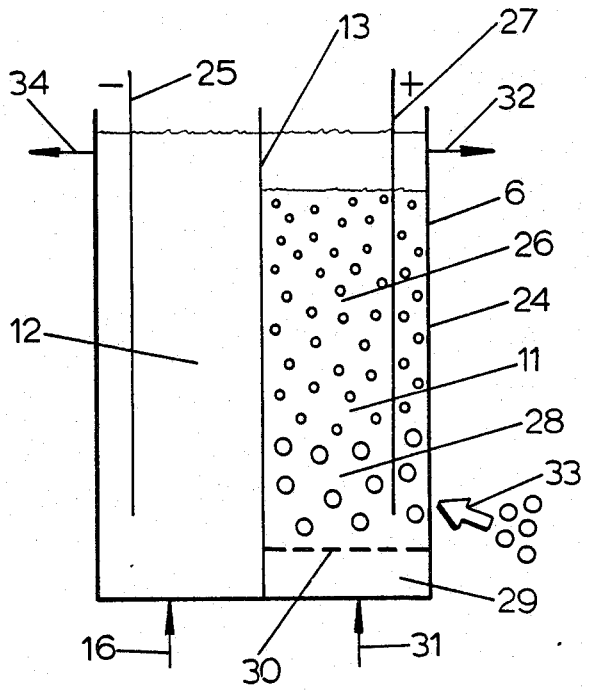

The electrolytic cell 6 is shown in more detail in FIG. 2 comprises a tank 24 with a cathode chamber 12 containing an insoluble cathode 25, an anode chamber 11 containing a tin anode system 26 comprising an insoluble anode 27 and the bed of granular tin material 28 which is fluidised during operation, and a wall 13 such as a membrane which is impermeable or virtually impermeable to tin ions. The insoluble anode can be a fully inert material such as carbon or a metal of the platinum group or may have an electrically conductive core coated with a metal of the platinum group or oxides thereof. This insoluble anode can have any suitable shape, e.g. tube, sheet, wire, rod or gauze.

The anode chamber has a compartment 29 at the bottom which is bounded at the upper side by a perforated plate 30, on which the bed of granular tin material 28 rests (when not fluidized). The anolyte is passed at 31 into the compartment 29 of the anode chamber 11, is passed into the bed 28 distributed evenly by perforated plate 30, divalent tin ions being taken up in the bed, and is discharged at 32. At 33 fresh granular tin material is supplied.

The catholyte is added to cathode chamber 12 at 16 and discharged at 34. In the cathode chamber 12, provided that the wall 13 can withstand it, a higher pressure is applied than prevails in the anode chamber 11, as a result of which the transport of tin ions through the wall 13 is hindered.

What is claimed is:

1. Method of electrolytic tinning using an insoluble anode, comprising the steps of:

(a) passing metal to be tinned in strip form through an electrolytic tinning bath having an insoluble anode and containing an acidic liquid electrolyte including tin ions, with the strip forming the cathode and causing current to flow so as to deposit tin from the electroyte onto the strip, and (b) circulating said electrolyte through an electrolytic replenishing cell having a bed of granular tin material outside said tinning bath for an addition of tin ions to the electrolyte in order to maintain the desired concentration of tin ions in the electrolyte in the tinning bath, said replenishment cell comprising (i) a tin anode chamber having a tin anode system comprising an insoluble tin anode and a bed of granular tin material, (ii) a cathode chamber having an insoluble cathode, and (iii) a membrane system between the anode chamber and the cathode chamber which is substantially impermeable to tin ions, said electrolyte being passed through the anode chamber of the replenishing cell so as to contact the tin anode system and there being electrolytically enriched with tin ions.

2. Method according to claim 1 wherein said bed of granular tin material is supported by a perforated plate in said anode chamber of the replenishing cell and said electrolyte is passed into the anode chamber beneath the perforated plate so as to pass upwardly through the plate, which distributes the electrolyte, and the bed.

3. Method according to claim 1 wherein the said bed of granular tin material is fluidized by the passage of the electrolyte through it.

4. Method according to claim 2 wherein the said bed of granular tin material is fluidized by the passage of the electrolyte through it.

5. Method according to claim 1 wherein in the cathode chamber of the replenishing cell, a higher pressure is maintained than in the anode chamber.

* * * * *

UNITED STATES PATENT AND TRADEMARK OFFICE

CERTIFICATE OF CORRECTION

PATENT NO. : 4,789,439

DATED : December 6, 1988

INVENTOR(S) : Huig BUNK et al

It is certified that error appears in the above-identified patent and that said Letters Patent is hereby corrected as shown below: Title page:

Abstract, line 15, "insoluble tin anode" should read --insoluble anode--.

Column 1, line 29, "plastics" should read --plating--.

Column 4, line 29, "insoluble tin anode" should read --insoluble anode--.

Signed and Sealed this

Twenty-seventh Day of June, 1989

*Attest:*

DONALD J. QUIGG

*Attesting Officer*

*Commissioner of Patents and Trademarks*